US006055403A

United States Patent [19]

Watanabe

[11] Patent Number: 6,055,403

[45] Date of Patent: Apr. 25, 2000

[54] FIXING MEMBER FIXING APPARATUS AND ELECTROPHOTOGRAPHIC APPARATUS USING THEM

[75] Inventor: Osamu Watanabe, Yokohama, Japan

[73] Assignee: Canon Kabushiki Kasiha, Tokyo, Japan

[21] Appl. No.: 09/236,582

[22] Filed: Jan. 26, 1999

[30] Foreign Application Priority Data

Jan. 28, 1998 [JP] Japan ..... 10-015692

[51] Int. Cl.[7] ..... G03G 15/20; H05B 1/00

[52] U.S. Cl. ..... 399/328; 219/216; 399/330

[58] Field of Search ..... 399/320, 324, 399/328, 330, 331, 332, 335; 219/216, 619; 430/124

[56] References Cited

U.S. PATENT DOCUMENTS

| | | | |
|---|---|---|---|
| 5,009,687 | 4/1991 | Kromrey | 65/18.1 |
| 5,475,194 | 12/1995 | Wantanabe et al. | 219/216 |
| 5,565,273 | 10/1996 | Egli et al. | 428/426 |
| 5,659,867 | 8/1997 | Young | 399/330 |
| 5,732,318 | 3/1998 | Natsuhara et al. | 399/329 |
| 5,768,673 | 6/1998 | Morigami | 399/330 |

FOREIGN PATENT DOCUMENTS

| | | |
|---|---|---|
| 54-039645 | 3/1979 | Japan . |
| 59-033787 | 2/1984 | Japan . |
| 7-114276 | 5/1995 | Japan . |

*Primary Examiner*—Arthur T. Grimley
*Assistant Examiner*—Hoang Ngo
*Attorney, Agent, or Firm*—Fitapatrick, Cella, Harper & Scinto

[57] ABSTRACT

A fixing member has a hollow fixing roller and an induction coil inside the fixing roller for generating heat from an induction current. The fixing roller has an outer surface and an inner surface, the inner surface facing the induction coil and the inner surface also having a heat insulating layer formed of hollow glass.

12 Claims, 3 Drawing Sheets

FIXING MEMBER FIXING APPARATUS AND ELECTROPHOTOGRAPHIC APPARATUS USING THEM

BACKGROUND OF THE INVENTION

1. Field of the Invention

The present invention relates to a fixing member and a fixing apparatus used for an image forming apparatus such as an electrophotographic copier, printer, or facsimile terminal equipment and to an electrophotographic apparatus making use of the fixing member and the fixing apparatus.

2. Related Background Art

A copier, which is an electrophotographic apparatus, has a fixing apparatus mounted therein to fix a toner image which is transferred onto a sheet such as recording paper or a transfer material, which is a recording medium. The fixing apparatus has, for example, a fixing roller also called as a heating roller that thermally melts a toner on a sheet, and a pressurizing roller that is brought into pressure contact with the fixing roller to sandwich or pinch the sheet therebetween.

The fixing roller is formed to be hollow, and on its central shaft, a heating element is held by a holding means.

The heating element is composed of, for example, a tubular heater such as a halogen lamp and generates heat when a predetermined voltage is applied to it.

Since the halogen lamp is located on the central shaft of the fixing roller, heat from the halogen lamp is radiated uniformly to the inner wall of the fixing roller, and the temperature distribution in the outer wall of the fixing roller is uniform in the circumferential direction.

The outer wall of the fixing roller is heated until its temperature reaches a value suitable for fixation of images (for example, between 150 and 200° C.). Under this condition, the fixing and pressurizing rollers are rotated in the opposite direction while being mutually pressure-contacted in order to sandwich therebetween a sheet with toner deposited thereon. The toner on the sheet is melted at the pressure-contacted portion (hereafter also referred to as a "nip") between the fixing and pressurizing rollers due to heat from the fixing roller and is fixed onto the sheet due to pressure effected by both rollers.

However, the fixing apparatus including a heating element composed of, for example, a halogen lamp uses heat radiated from the halogen lamp to heat the fixing roller, so a relatively long time is required from power-on until the temperature of the fixing roller reaches a predetermined value suitable for fixation (hereafter referred to as "warm-up time"). During this time, the user cannot use the copier and must wait over a long time.

On the other hand, if a large amount of electric power is applied to the fixing roller to improve user operability in order to reduce the warm-up time, the power consumption of the fixing apparatus increases to contradict efforts to save energy.

Thus, to improve the value of products such as copiers, more efforts have been made to achieve both energy saving for the fixing apparatus (reduction of power consumption) and the improvement of the user operability (quick print).

As an apparatus that meets such a requirement, a fixing apparatus based on the induction heating method and using high-frequency induction as a heating source has been proposed as shown in Japanese Patent Application Laid-Open No. 59-33787. This induction heating fixing apparatus comprises a coil located concentrically inside a hollow fixing roller consisting of a metal conductor so that high-frequency magnetic fields are generated when a high-frequency current is caused to flow through the coil and the magnetic fields generate an induction eddy current in the fixing roller, which is then Joule-heated due to its skin resistance.

This fixing apparatus based on the induction heating method significantly improves the electricity-heat conversion efficiency to enable the warm-up time to be reduced.

In this fixing apparatus, however, the temperature around the coil substantially increases due to heat radiation to the inner surface of the fixing roller, thereby increasing the electric resistance of the coil and thus required power.

In addition, the coating of the coil consisting of a resin is melted by heat, thereby degrading the insulation of the coil.

These problems also apply to a type that uses as a heating member a thin flexible metal sleeve instead of the fixing roller.

Thus, to restrain an increase in the temperature of the coil, the provision of a cooling mechanism such as a blowing means inside the fixing roller has been proposed as disclosed in, for example, Japanese Patent Application Laid-Open No. 54-39645.

If, however, a cooling mechanism is installed in the conventional fixing apparatus based on the induction heating method, an installation space is required for this mechanism, resulting in the increased size of the apparatus and thus increased costs.

In addition, not only the induction coil and the core but also the inner surface of the fixing roller are cooled by air blow, thereby degrading the fixing capability.

In addition, to restrain an increase in the temperature of the coil, the provision of a low thermal conductive layer formed of, for example, polyimide or polyamide imide in the inner surface of the fixing roller has been proposed (Japanese Patent Application Laid-Open No. 7-114276).

SUMMARY OF THE INVENTION

It is an object of this invention to provide a fixing member comprising a more effective heat insulating layer that prevents an increase in the temperature of an induction coil for the fixing member.

It is another object of this invention to provide a fixing apparatus and an electrophotographic apparatus both comprising the above fixing member.

This invention provides a fixing member generating heat due to an induction current characterized by having a heat insulating glass layer in a surface of the fixing member opposite to its fixing surface.

This invention also provides a fixing apparatus having a fixing member generating heat due to an induction current and a pressurizing member located in pressure contact with the fixing member, characterized by having a heat insulating glass layer in a surface of the fixing member opposite to its fixing surface.

In addition, this invention provides an electrophotographic apparatus using the fixing member or the fixing apparatus.

The heat insulating glass layer applied to the fixing member according to this invention has a heat insulating structure and can effectively block heat from a heating section of the fixing member. In addition, if the heating section is a metal roller, since the thermal expansion rate of the heat insulating glass layer is almost the same as that of the metal roller, thereby preventing the releasing of the heat insulating glass layer caused by the difference in thermal expansion rate.

DETAILED DESCRIPTION OF THE PREFERRED EMBODIMENTS

Figure 1:
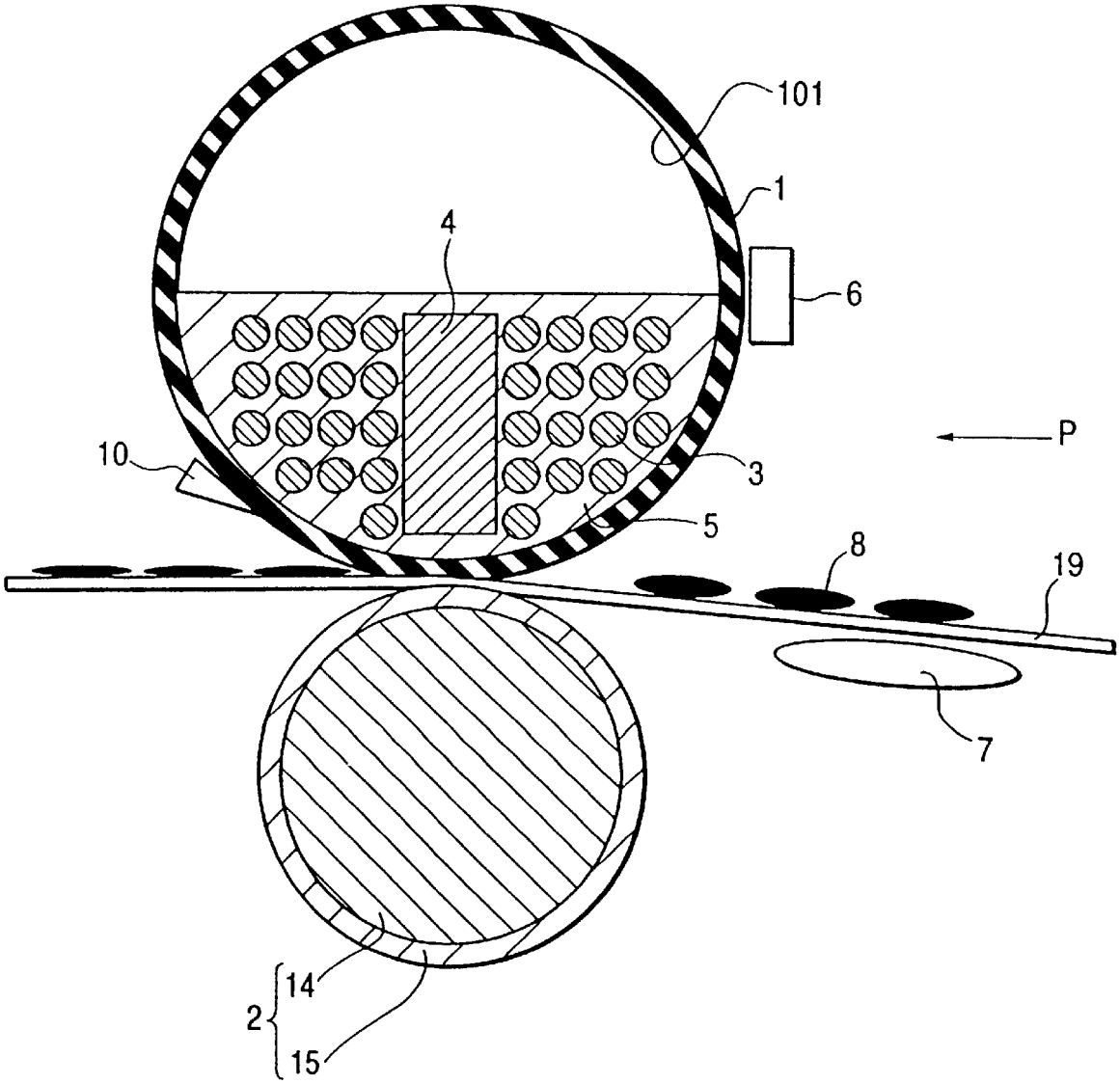
FIG. 1 is a pictorial sectional view schematically showing a fixing apparatus according to Example 1 of this invention.

Hollow glass is preferably used for the heat insulating structure of a heat insulating glass layer applied to a fixing member according to this invention. The hollow glass includes a vacuum or a gas such as air inside to enable significant heat resistance. Preferable hollow glass includes hollow glass beads and plates. A fixing member can assume an arbitrary shape such as a cylinder or a plate. If the fixing member is shaped like a cylinder, then a heat insulating glass layer can be formed by staining and baking hollow glass beads onto, for example, the inner surface of the cylinder. If the fixing member is shaped like a hollow glass plate, then a heat insulating glass layer can be formed by inserting and fixing a tube formed of the hollow glass plate. In addition, a paint prepared by dispersing hollow glass beads in a binding agent can be coated on the inner surface of the cylinder to form a heat insulating glass layer.

Next, a cylindrical fixing member, that is, a fixing roller will be specifically explained as an example of the fixing member according to this invention.

The fixing roller comprises a heat source inside and is disposed in such a way as to pressure-contact a pressurizing roller. The fixing roller has a heat insulating glass layer in its inner surface.

The heat insulating glass layer in the inner surface blocks heat generated from the fixing roller to prevent the temperature of an internal heat source from increasing and to cause heat to flow in the direction of the nip, thereby contributing to energy saving for the fixing apparatus.

Since the heat insulating glass layer is a non-magnetic substance, no heat is generated from the heat insulating glass layer and the above effect becomes significant.

This effect can be obtained relatively inexpensively when the heat insulating layer is formed by staining and baking hollow glass beads in the inner surface of the fixing roller.

According to this invention, a fixing apparatus based on the induction heating method comprises a heating member that generates heat due to an induction current, a pressurizing member provided in pressure contact with the heating member, and an induction coil that is provided within the heating member and generates a magnetic flux that is supplied to the heating member, wherein the heating member is cylindrical and has a heat insulating glass layer in its inner surface.

This particular aspect prevents the temperature of the induction coil from increasing to provide a fixing apparatus that can save energy and perform high durability.

In addition, if a roller is used that has in its inner surface three layers including an air layer, a heat reflecting layer, and a heat insulating glass layer, the air layer provides a heat insulating effect, and further the heat reflecting layer effects infrared reflection to more effectively block heat from the roller. A higher heat insulating effect can be obtained by introducing a vacuum layer instead of the air layer.

Even in an external arrangement in which the fixing roller is heated from its outer surface instead of placing an induction coil unit inside that is a heat source for the fixing roller, heat generated during start-up is prevented from escaping to the hollow inside of the fixing roller by providing the heat insulating glass layer in the inner surface, thereby reducing the start-up time despite the same power applied.

FIG. 1 is a pictorial sectional view schematically showing an induction heating fixing apparatus according to this invention. In a fixing roller 1, for example, 10 to 50 $\mu$m of PTFE (tetrafluorethylene resin) or 10 to 50 $\mu$m of PFA (copolymer resin of tetrafluorethylene and perfluoroalkyl vinyl ether) may be provided in a core metal, or mandrel cylinder made of iron having an outer diameter of 40 mm and a thickness of 0.7 mm in order to allow the surface of the cylinder to be released appropriately. A PTFE layer having a thickness of 20 $\mu$m is formed in the Examples given later.

A pressurizing roller 2 consists of a hollow core metal, or mandrel 14 and an elastic layer 15 that is a surface-releasing heat resistant rubber layer formed on the outer periphery circumferential surface of the hollow core metal 14. Bearings are formed at the respective ends of the pressurizing roller 2 and are rotatably mounted on a fixing unit frame (not shown).

The fixing roller 1 and the pressurizing roller 2 are rotatable supported, and only the fixing roller 1 is designed to be driven. The pressurizing roller 2 is located in such a way as to pressure-contact the surface of the fixing roller 1 and is arranged to be rotated with the fixing roller due to the frictional force at the pressure-contacted portion (nip). In addition, a mechanism (not shown) using a spring is provided to pressurize the pressurizing roller 2 in the direction of the rotating shaft of the fixing roller 1.

The pressurizing roller 2 is subjected to an about-30-kg load, wherein the width of the pressure-contacted portion (nip width) is about 6 mm. The load, however, may be changed as appropriate to change the nip width.

Figure 2:
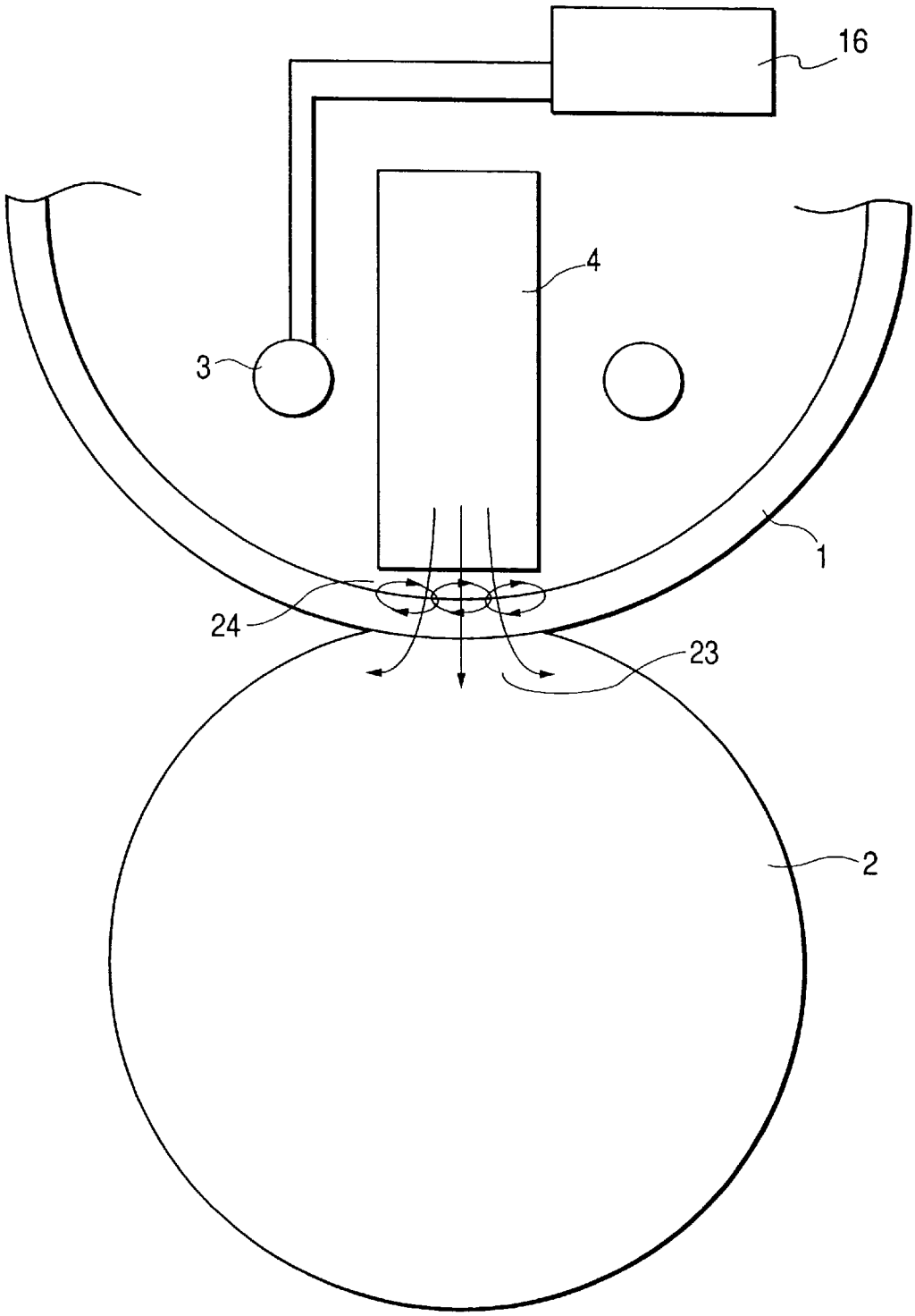
FIG. 2 is a pictorial explanatory drawing showing the principle of heating for the fixing apparatus according to Example 1.

The principle of heating inside the fixing nip will be explained with reference to FIG. 2.

Magnetic fluxes are generated by an current which is applied to an induction coil 3 by an exciting circuit 16 and are guided through a high-permeability core 4 to generate magnetic fluxes 23 and eddy currents 24 in the fixing nip in the core metal of the fixing roller 1. The eddy currents 24 and the resistivity of the fixing roller generate heat.

The induction coil 3 is disposed inside a holder 5 consisting of a heat resistant resin such as PPS (polyphenylenesulfide), PEEK, or a phenol resin so as to be wrapped around the core 4. A 10-to-100-kHz AC current is applied to the induction coil 3. Magnetic fields induced by the AC current cause eddy currents to flow through the inner surface of the fixing roller 1 that is a conductive layer, thereby generating Joule heat.

To increase the heat generation, the number of windings of the induction coil 3 may be increased, or the core 4 may be formed of a material that has a higher permeability and a lower residual magnetic flux density, such as ferrite or permalloy, or the frequency of the AC current may be increased.

A temperature sensor 6 is located in such a way as to abut on the surface of the fixing roller 1. Automatic control is provided in such a way that the power supply to the induction coil 3 is increased or reduced based on a detection signal from the temperature sensor 6 to maintain the surface temperature of the fixing roller 1 at a predetermined constant temperature.

A transporting guide 7 is located in such a position as to guide a transfer material 19 that is conveyed in the direction of area P while carrying a unfixed toner image 8, to the pressure-contacted portion (nip) between the fixing roller 1 and the pressurizing roller 2.

A separating claw 10 is located in such a way as to abut on the surface of the fixing roller 1 or is located in proximity to this surface.

EXAMPLE 1

Figure 4:
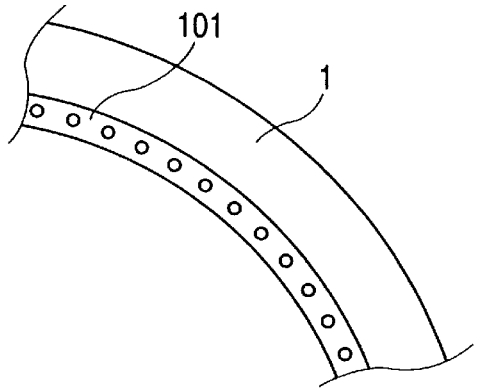
FIG. 4 is a pictorial sectional view schematically showing a fixing roller according to Example 1.

FIG. 4 is a pictorial sectional view schematically showing the fixing roller according to Example 1.

Figure 5:
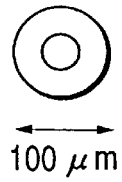
FIG. 5 is a pictorial sectional view showing a hollow glass bead according to Example 1.

According to this example, the fixing roller shown in FIG. 1 uses a heat insulating layer 101 (a glass coat layer) formed by baking hollow glass beads onto the inner surface of the fixing roller 1, as shown in FIG. 4. First, the hollow glass beads were kneaded with an organic solvent until this material became like a paint, which was then coated on the inner surface of the fixing roller to which a heat resistant adhesive had been applied. The coating was baked at 900° C. to form a glass coat layer. In this case, due to the hollow shape of the glass beads as shown in FIG. 5, the glass coat layer is porous and provides excellent heat insulation.

In this case, the glass beads may be composed of usual silicate glass, but preferably contain no metal or magnetic substance to prevent heat generation caused by magnetic fields from the induction coil. The hollow glass beads according to this example have a diameter of about 100 $\mu$m. In this case, the glass coat layer is formed to have a thickness of about 200 $\mu$m.

Figure 3:
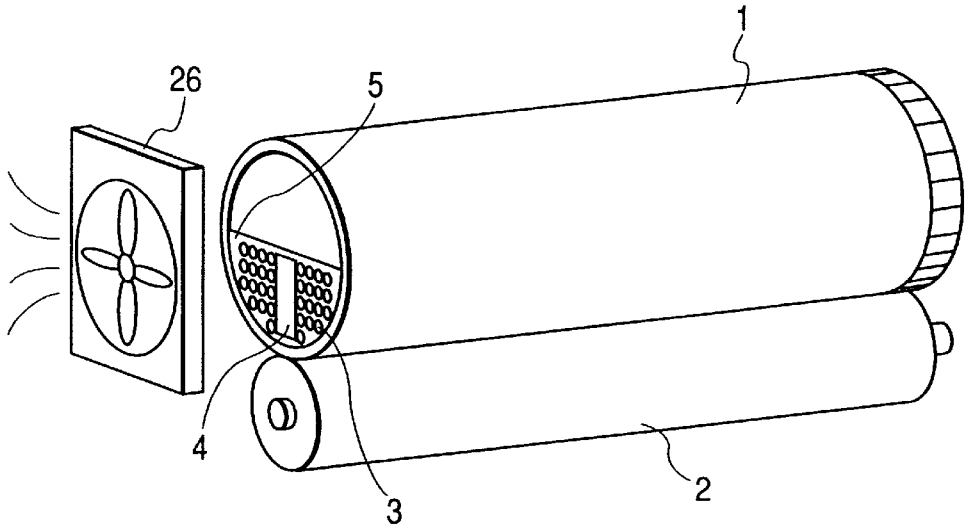
FIG. 3 is a perspective explanatory drawing showing an example of fan cooling.

In Comparison (a), the heat insulating layer comprised a polyimide layer having a thickness of about 200 $\mu$m instead of the above glass coat layer. In Comparison (b), no heat insulating layer was provided in the fixing roller shown in FIG. 1. In Comparison (c), the fixing roller in comparison (b) was used, and a fan 26 was used for cooling as shown in FIG. 3. The fan 26 had a diameter of 40 mm and an air capacity of $3.0\times10^{-2}$ $m^3$/sec.

To heat the fixing roller, a 100-V high-frequency AC voltage was applied at a frequency of 20 kHz and an initial power of 1,300 W to increase the surface temperature of the fixing roller from the room temperature to 200° C.

The power required to maintain the fixing roller at 200° C. was as shown below.

| | |
|---|---|
| Present example | 480 W |
| Comparison (a) | 520 W |
| Comparison (b) | 730 W |
| Comparison (c) | 580 W |

By baking the hollow glass beads in the inner surface of the fixing roller 1 as a heat insulating member as done in this example, the increase in the temperature of the induction coil 3 can be prevented, and the roller can be effectively heated in the nip direction to increase the heating efficiency and to save power without reducing the fixing capability.

EXAMPLE 2

Figure 6:
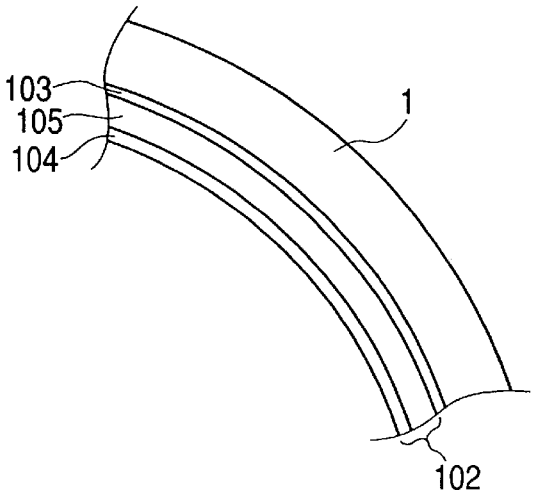
FIG. 6 is a pictorial sectional view schematically showing a fixing roller according to Example 2.

A fixing roller was produced by forming a heat insulating glass layer 102, which is shown in FIG. 6, instead of the glass coat layer in Example 1. That is the heat insulating glass layer 102 was formed in such a way that in the inner surface of the fixing roller, air was sealed within a space 105 between a silicate glass layer 103 having a thickness of 0.5 mm and a silicate glass layer 104 having a thickness of 1 mm.

When this fixing roller was used to conduct tests similar to those in Example 1, the results were similar to those of the glass coat layer in Example 1.

A different gas such as nitrogen may be sealed in the space 105, or the space may be evacuated.

What is claimed is:

1. A fixing member comprising:

a hollow fixing roller; and an induction coil inside said fixing roller for generating heat from an induction current, wherein said fixing roller has an outer surface and an inner surface, the inner surface facing said induction coil, and wherein said inner surface comprises a heat insulating glass layer formed of hollow glass.

2. A fixing member according to claim 1 wherein the heat insulating glass layer is formed of hollow glass beads.

3. A fixing member according to claim 2 wherein the hollow glass is hollow glass beads.

4. A fixing member according to claim 2 wherein the heat insulating glass layer is formed by baking the hollow glass beads onto the inner surface of the fixing roller.

5. A fixing member according to claim 1 wherein said glass layer is a hollow glass plate.

6. A fixing member according to claim 5 wherein the hollow glass plate is a glass tube formed in the inner surface of the fixing member and has a space between the inner and outer walls of the glass tube.

7. A fixing member according to claim 1 wherein the fixing roller is cylindrical.

8. A fixing apparatus comprising:

a fixing member comprising:

a hollow forming roller; and an induction coil for generating heat from an induction current, wherein said fixing roller has an outer surface and an inner surface, the inner surface facing said induction coil, and wherein said inner surface comprises a heat insulating glass layer formed of hollow glass; and a pressure member in pressure contact with the fixing member.

9. A fixing apparatus according to claim 8 wherein the heat insulating glass layer is formed of hollow glass.

10. A fixing apparatus according to claim 9 wherein the hollow glass is hollow glass beads.

11. A fixing apparatus according to claim 9 wherein the hollow glass is a hollow glass plate.

12. A fixing apparatus according to claim 8 wherein the fixing member is cylindrical.

* * * * *